United States Patent [19]

Zilges et al.

[11] Patent Number: 4,809,531

[45] Date of Patent: Mar. 7, 1989

[54] MEANS AND METHOD FOR REMOVING TRAPPED BILLETS FROM INDIRECT EXTRUSION PRESS

[75] Inventors: Franz-Josef Zilges, Monchen-Gladbach, Fed. Rep. of Germany; Johannes-Ulrich Weiss, Zurich, Switzerland

[73] Assignee: SMS Schloeman-Siemag Aktiengesellschaft, Dusseldorf, Fed. Rep. of Germany

[21] Appl. No.: 275,030

[22] Filed: Jun. 18, 1981

[30] Foreign Application Priority Data

Jun. 23, 1980 [DE] Fed. Rep. of Germany ..... 3023388

[51] Int. Cl.[4] ..... B21C 26/00; B21C 35/00

[52] U.S. Cl. ..... 72/273.5; 72/273; 72/263; 72/265

[58] Field of Search ..... 72/263, 270, 273, 273.5, 72/254, 255, 253.1, 257, 265

[56] References Cited

U.S. PATENT DOCUMENTS

| | | | |
|---|---|---|---|
| 715,358 | 12/1902 | Dick | 72/263 |
| 2,858,017 | 8/1958 | Kent et al. | 72/263 |
| 4,326,399 | 4/1982 | Doudet | 72/263 |
| 4,342,212 | 8/1982 | Sibler | 72/273.5 |

FOREIGN PATENT DOCUMENTS

| | | | |
|---|---|---|---|
| 514735 | 12/1930 | Fed. Rep. of Germany | 72/270 |
| 570750 | 2/1933 | Fed. Rep. of Germany | 72/270 |
| 2613090 | 10/1976 | Fed. Rep. of Germany | 72/263 |
| 14859 | 7/1974 | Japan | 72/273.5 |
| 28613 | 2/1982 | Japan | 72/273.5 |
| 262472 | 7/1927 | United Kingdom | 72/273.5 |

*Primary Examiner*—Lowell A. Larson

*Attorney, Agent, or Firm*—Holman & Stern

[57] ABSTRACT

Metal billets trapped in the billet container of an indirect extrusion press are removed by indirect extrusion in the reverse direction until the billet size is reduced sufficiently for the residue to be expelled bodily from the container. The stem used to support the container-closing plug constitutes, or is replaced by a stem for effecting the reverse indirect extrusion.

20 Claims, 5 Drawing Sheets

MEANS AND METHOD FOR REMOVING TRAPPED BILLETS FROM INDIRECT EXTRUSION PRESS

BACKGROUND OF THE INVENTION

1. Field of the Invention

This invention concerns the construction and operation of indirect metal extrusion presses.

2. Description of the Prior Art

The characteristic feature of indirect extrusion is that there is no relative movement between the sides of the billet to be extruded, and the walls of the billet container. Consequently, the force required for extrusion is reduced and relatively large billets can be extruded. This however leads to problems if a billet becomes trapped in the container, that is to say, if for any reason the billet cannot be extruded in the normal manner. Removal of a trapped billet is difficult or impossible, as the built-in operating force of the press is in general not enough to expel a relatively long billet, when applied against the high friction between the billet and the internal surface of the billet container. A billet can become trapped ("locked in" or "frozen in"), for example because its temperature has dropped to a level at which it cannot be extruded at the normal high conversion ratio and cannot or ought not to be brought up to a sufficient temperature in the press. A billet may also become trapped for example if the extrusion die breaks.

BRIEF SUMMARY OF THE INVENTION

An object of the present invention is to enable trapped billets to be removed easily from indirect metal extrusion presses.

According to the invention, the closure at the rear end of the billet container constitutes, or is replaceable by, an extrusion element (which can be in the form of an extrusion die or a piercing element) which can be forced into the billet container to cause indirect extrusion of the billet in the reverse direction. This extrusion element can provide a conversion ratio smaller than that of the main extrusion die in the press, so that the reverse extrusion requires less force than forward extrusion.

The invention is particularly applicable to extrusion presses of the kind consisting of a press frame formed of a cross head carrying a main press cylinder, an opposed cross head or platen for supporting the extrusion die, and tie members which interconnect these cross heads, a hollow stem mounted on the die cross head and carrying the extrusion die at its free end, an axially slidable container holder which holds the billet container and is guided in the press frame, and a movable closure support cross head carrying a stem for closing the rear end of the billet container, this cross head being moved by the piston of the main press cylinder. For extruding pipes or hollow profiles, such presses are also commonly provided with piercing mandrels slidable through the closure stem and into the die by means of auxiliary cylinders and pistons, the closure stem being hollow in this case.

In such a press, in practising the present invention the closure stem can be replaced by a hollow stem or a profiled stem of which the available cross section is only partly filled and which has a circumscribed circle of the same diameter as the closure stem and has outwardly open profile segments; or the closure stem, used to support a closure disc or plug, is a hollow stem or a profile stem as just described.

When a billet becomes trapped in the press, in general the container closure disc or plug inserted into the container also becomes locked into the container bore, and can be removed only by the use of considerable force. In order to make this possible without additional equipment, according to a further characteristic of the invention, the closure disc can be connected in a tensionally resistant manner to the closure stem or to the hollow or profile stem. As a plurality of sealing discs is required, it is advantageous to provide connecting means which involve low preparation cost, in particular with regard to the sealing discs. Any weakening of the sealing discs due to the connection means must also be avoided. For these reasons, according to a further feature of the invention, each sealing disc and the sealing, hollow or profile stem are provided at their facing ends with shoulders formed by annular reliefs, and connectable by means of a split clamping collar provided with counter-shoulders which engage in the reliefs and lockable by means of a screw collar ring.

In the preferred operating method, in order to remove "locked-in" metal billets, after taking out the closure disc and if using a special closure stem after replacing this stem with a hollow or profiled stem, the locked-in billet is extruded against the hollow or profiled stem, on which an auxiliary die is mounted or formed, in the opposite direction to the normal extrusion direction, indirectly over the profiled stem or into the hollow stem, either continuously or by a successively interrupted stroke, then the emerging extrusions are separated into chargeable pieces of scrap, until it becomes possible to press the remains of the billet out, for which purpose, in known manner, a sleeve is inserted between the moving crosshead and billet container having a somewhat greater inner diameter than the container bore, in order to receive the billet remains.

If the sealing disc and the sealing, hollow or profile stem comprise shoulders formed by reliefs at their facing ends, and can be connected together by means of a clamping collar, then during the extrusion operation the container holder and moving crosshead are moved into a relative position, and are retained in this position by known couplings between the container holder and moving crosshead, so that if a billet becomes locked-in, the sealing disc protrudes from the container by way of the shoulder and relief, and before removing the locked-in billet, the sealing disc is connected to the sealing, hollow or profile stem, and the sealing disc is pulled out by means of the sealing, hollow or profile stem.

BRIEF DESCRIPTION OF THE DRAWINGS

Embodiments of the invention are shown in the accompanying drawings, wherein.

DETAILED DESCRIPTION

Figure 1:
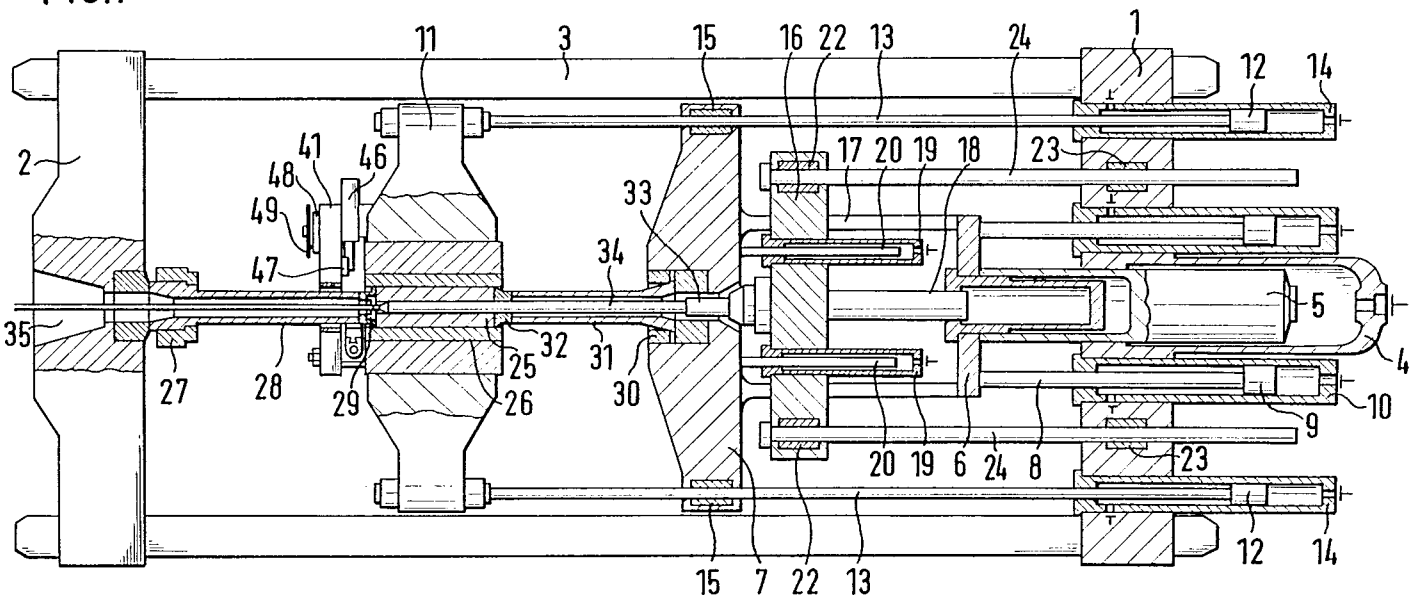
FIG. 1 is a diagrammatic cross-sectional view of an indirect metal extrusion press for manufacturing hollow profiles.

The indirect metal extrusion press shown in FIG. 1 consists of the press frame, formed from a cylinder crosshead 1, a die crosshead or counterplaten 2, and tie bars 3 which connect these together. The cylinder crosshead 1 carries the main press cylinder 4, in which slides a first plunger piston 5 forming the main press piston. The piston 5 is connected by a framework 6 to a moving closure support crosshead 7, which is guided for axially sliding in the press frame along the tie bars 3. The piston 5 advances the moving crosshead 7, whereas for withdrawal purposes piston rods 8 are connected by way of the framework 6 to the moving crosshead 7, and are located with their pistons 9 in withdrawal cylinders 10, these being supported by the cylinder crosshead 1 as is the main cylinder 4.

A crosshead forming a billet container holder 11 is also axially movable in the press frame along the tie bars 3, and is moved by means of holder pistons 12 which are connected to the holder 11 by holder piston rods 13 and are located in holder cylinders 14, which are likewise supported by the cylinder crosshead 1. Clamps 15 located in the moving crosshead 7 can grip around the holder piston rods 13, by which means the crosshead 7 can be firmly connected in a frictionally resistant manner to the holder piston rods 13, so that the crosshead 7 becomes firmly connected both to the container holder 11 and to the holder pistons 12.

In order to be able to extrude hollow profiles with the press, a piercing mandrel 34 is required, and this is fixed to a mandrel crossbar 16. The crossbar 16 is guided for axial movement in extensions 17 provided in the framework 6 which connect the moving crosshead 7 to the main piston 5. The piston 5 is hollow and open towards the crossbar 16, so that it forms a cylinder for a second plunger piston 18 which can push the crossbar 16 forward. For the return of the crossbar 16, the latter is connected to cylinders 19 in which third plunger pistons 20 are located, supported on the moving crosshead 7. The crossbar 16 can be fixed in the press frame by means of clamps 22 in the crossbar 16 and clamps 23 in the cylinder crosshead 1, together with tie bars 24.

Figure 2A:
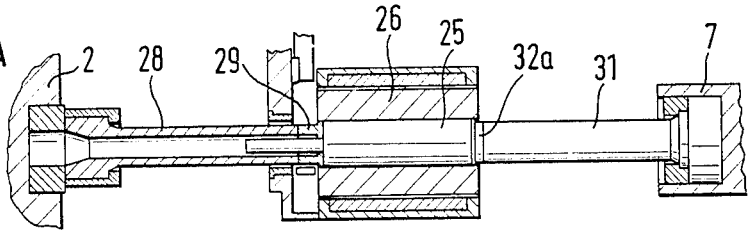
FIGS. 2*a* to 2*e* are diagrammatic cross-sectional views showing the use of a hollow stem for removing a locked-in billet with the press of FIG. 1.
Figure 3A:
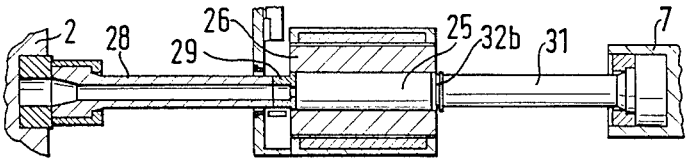
FIGS. 3*a* to 3*g* are views similar to FIG. 2*a* to 2*e* showing a different embodiment using a profile stem.

In order to extrude a metal billet 25, it is inserted into a container 26 which according to this invention has a front open end in the normal extrusion direction and an opposed coaxial rear open end (in the reverse extrusion direction), and which is carried by the holder 11. A die stem 28 fixed to the counterplaten 2 in the stem holder 27 supports an extrusion die 29. A closure stem 31 together with a container closure plug or disc 32 supported on it, which stem 31 is mounted in the stem holder 30 on the moving crosshead 7, is driven with the crosshead 7 against the rear of the billet 25, and the billet 25 is slid until it comes up against the die 29, (and if a hollow profile is to be extruded, after the mandrel 34 fixed in the mandrel holder 33 on the crossbar 16 has pierced the metal billet 25 and the mandrel point lies in the opening of the die 29), after which the clamps 15 are closed so that the holder 11 together with the container 26 are connected to the crosshead 7. The container 26, together with the closure disc 32 which seals it at the rear and the closure stem 31, now move together under the force of the first plunger piston 5 and the holder pistons 12 to slide the container over the die stem 28 and die 29, so that the metal billet 25 is indirectly extruded through the die to form an extrusion, which emerges through the hollow die stem 28 and opening 35 in the counterplaten 2. The structure and operation of the press described so far are known. If a billet becomes "locked-in" or trapped in the container 26, i.e. if the billet, from the beginning of extrusion or shortly thereafter, can no longer be extruded with the normal high conversion ratio, then the billet must be removed from the container. A corresponding initial situation is shown in FIGS. 2*a* and 3*a*, in which the billet 25 located in the container (carrier) 26, after the commencement of pressing (FIG. 2*a*), or after initial upsetting (FIG. 3*a*), cannot be extruded with the normal conversion ratio by using the maximum extrusion force of the press. Such a billet is removed in accordance with the invention as described below.

Figure 2B:
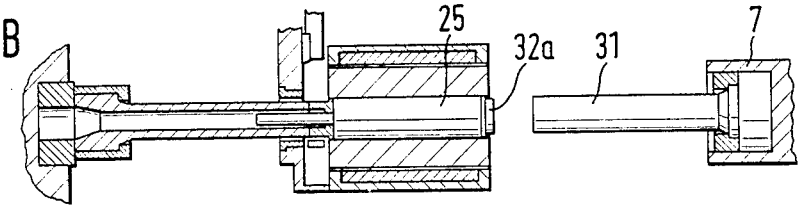
Figure 2C:
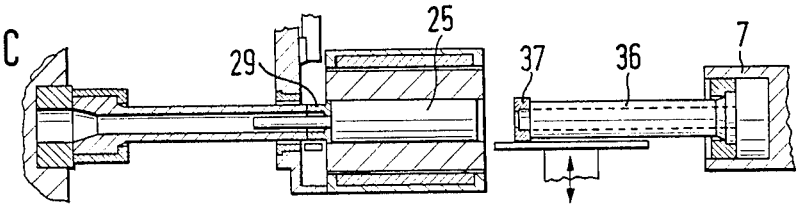
Figure 2D:
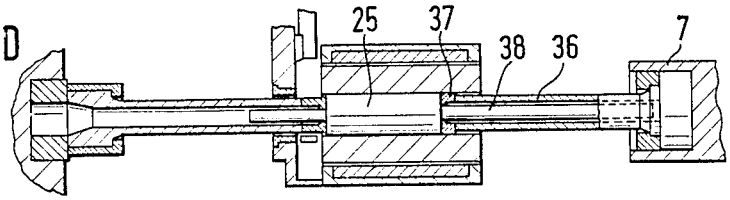
Figure 2E:
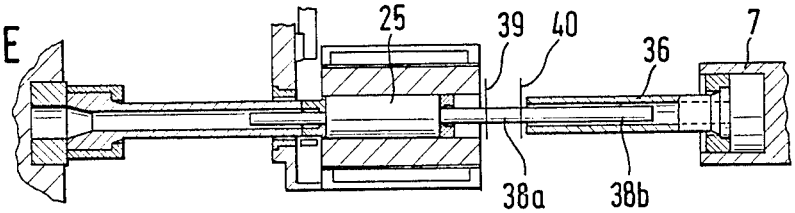
Figure 3B:
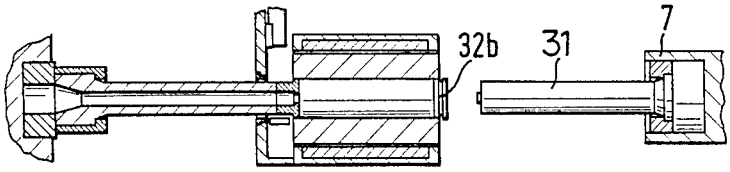

As shown in FIGS. 2*b* and 3*b*, the stem 31 is firstly moved back into its initial position. In the example of FIGS. 2*a* to 2*e* the closure disc 32*a* is them removed, this being done either with simple tools, or with special withdrawal devices, if the closure disc 32*a* is provided with corresponding notches or threads for connection to the withdrawal tool. It is also possible to connect together the disc 32*a* and stem 31 by means of a threaded bolt, to enable the disc 32*a* to be drawn out by retraction of the stem 31. The stem 31 is then also removed.

As shown in FIG. 2*c*, a hollow stem 36 supporting an auxiliary die 37 is then inserted into the moving crosshead 7 as a replacement for the normal closure stem 31. The auxiliary die 37 has a substantially larger die opening than the main extrusion die 29.

When the moving crosshead 7 with the hollow stem 36 and the auxiliary die 37 mounted thereon are driven against the billet 25 by activating the main first piston 5, the metal billet 25 is indirectly reverse extruded i.e. backwards, or opposite the normal forward extrusion direction, through the auxiliary die 37, forming a scrap extrusion 38 which enters the bore in the hollow stem 36 as shown in FIG. 2*d*.

As soon as the scrap extrusion 38 has attained a length somewhat less than the depth of the bore in the hollow stem 36, the moving crosshead 7 together with the hollow stem 36 is moved back into its initial position, corresponding to the position shown in FIG. 2*e*. By means of a saw movable transversely to the press axis on a support (not shown) and which comprises two saw blades 39 and 40, a portion 38*a* of the scrap extrusion 38 is separated and removed, so that the portion 38*b* of the scrap extrusion 38 can also be removed. By repeating this reverse extrusion operation once or several times, the metal billet 25 can be converted to a large extent into scrap extrusion pieces 38*a*, 38*b* etc., of chargeable length, because by virtue of the opening in the auxiliary die 37 a conversion ratio is maintained which can be overcome by the available extrusion force.

Figure 3C:
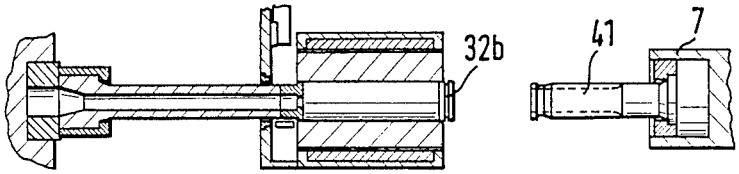
Figure 3D:
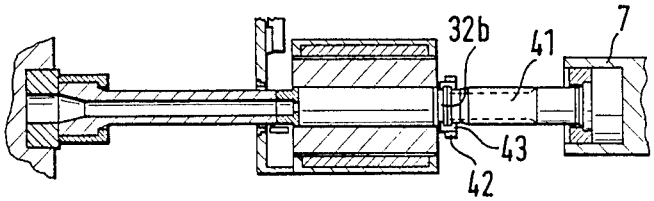
Figure 3E:
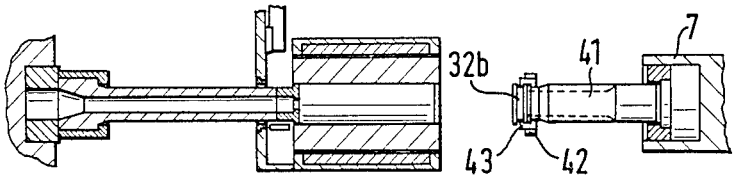
Figure 7:
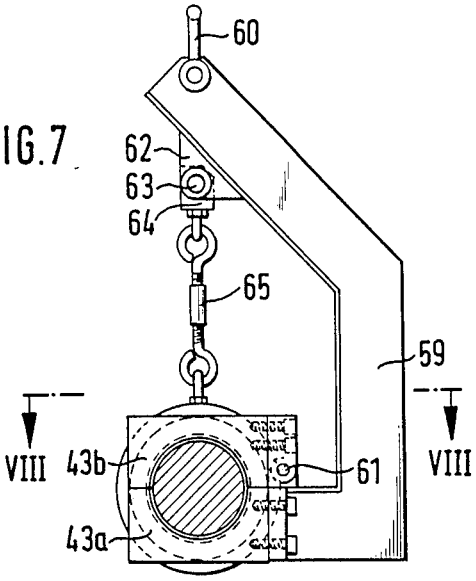
FIG. 7 is a cross-sectional view taken on the line VII—VII of FIG. 5.
Figure 8:
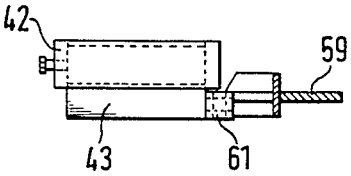
FIG. 8 is a cross-sectional view taken along the line C—C VII—VII of FIG. 7.
Figure 5:
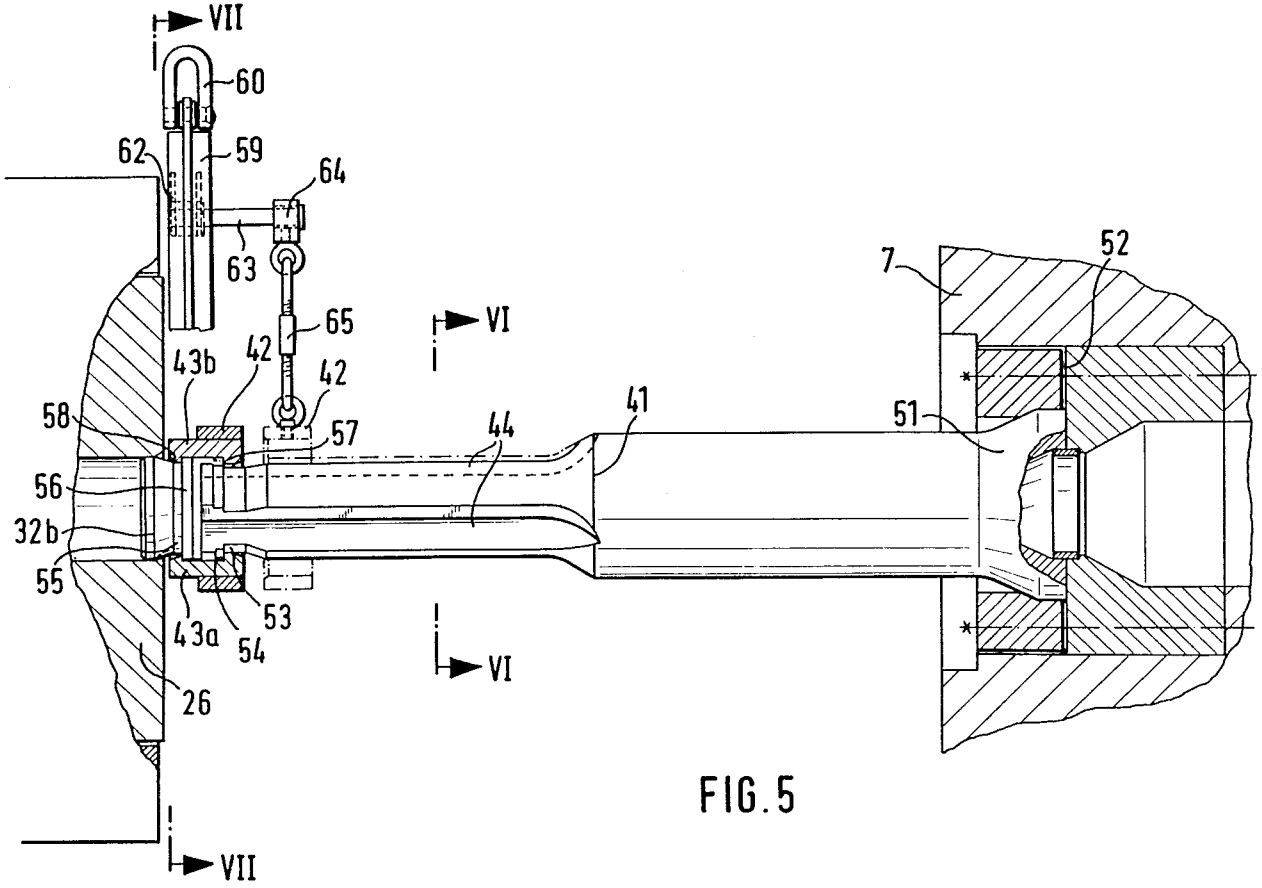
FIG. 5 is a detailed cross-sectional view of the profile stem and clamping collar for connecting the sealing disc to the profile stem.

In the example shown in FIGS. 3*a* to 3*g*, the closure stem 31 is replaced by a profiled stem 41, as can be seen in FIGS. 3*b* and 3*c*. The profiled stem 41 is then moved towards the closure disc 32*b* as shown in FIG. 3*d*, and the disc 32*b* and stem 41 are connected together by a clamping collar 43 consisting of two halves held together by a screw collar ring 42, as can be seen more clearly in FIGS. 5, 7 and 8. The profiled stem 41 is drawn backwards and the disc 32*b* is thus pulled out of the bore in the container (carrier) 26 with the moving crosshead 7 by the piston 9 acting by way of the tie bars 8 and framework 6, until the position shown in FIG. 3*e* is reached, on which the clamping collar 42 is released and the disc 32*b* can be removed.

Figure 3F:
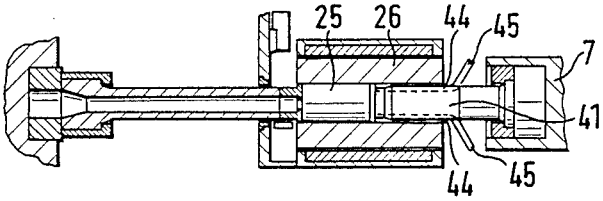
Figure 3G:
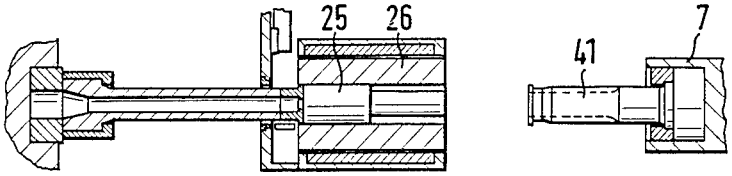
Figure 6:
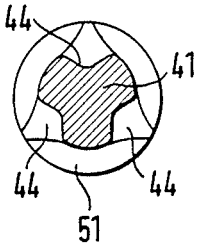
FIG. 6 is a cross-sectional view through the profile stem on the line VI—VI of FIG. 5.

By activating the main (first) extrusion piston 5, which acts by way of the framework 6 on the moving crosshead 7, the stem 41 is advanced into the billet in the container 26 and pierces the billet from the rear so that the billet is indirectly extruded over the three profile segments 44 (see FIG. 6) of the stem 41, in the direction opposite the normal extrusion direction, into three scrap extrusions 45, which firstly pass through the profile segments 44 and are then led off outwards outside the carrier 26 and divided into scrap pieces of handleable length, as shown in FIG. 3*f*. The profile segments 44 are of such a cross-section that the billet 25 can be extruded over the profile stem 41 with a considerably smaller conversion ratio than would be necessary for the main extrusion die 29 of the press, so that the force which the press can exert is enough for extruding with the profiled stem 41. When the billet 25 has been extruded to a sufficient extent, the moving crosshead 7 is moved back into the position shown in FIG. 3*g* together with the stem 41.

Figure 4A:
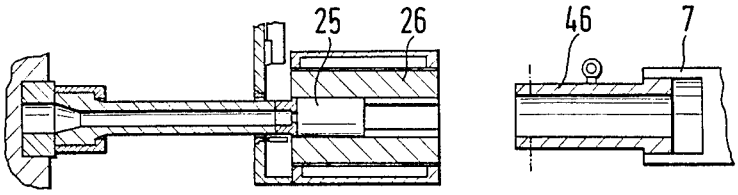
FIGS. 4*a* to 4*c* are views similar to FIGS. 2*a* to 3*a* which show the subsequent removal of the billet remains.
Figure 4B:
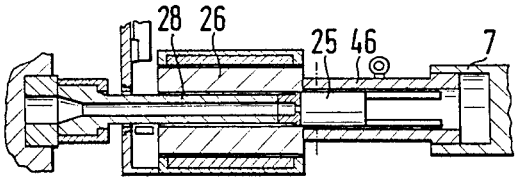
Figure 4C:
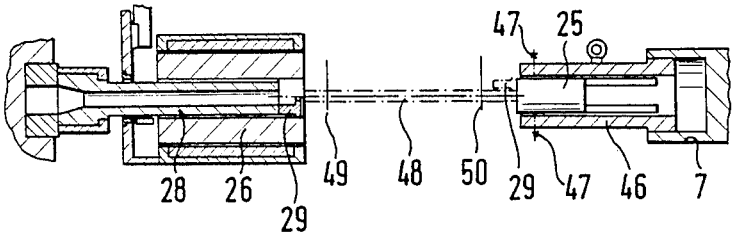

The billet 25 will have been extruded to the necessary or sufficient extent at the point when its remains can be moved in the container 26 using the available extrusion force. The hollow stem 36 (in the case of the embodiment shown in FIGS. 2*a* to 2*e*) or the profiled stem 41 (in the case of the embodiment shown in FIGS. 3*a* to 3*g*) is then replaced by a sleeve 46, the inner diameter of which is somewhat larger than the inner diameter of the container 26 (see FIG. 4*a*). By activating the main (first) extrusion piston 5, the sleeve 46 is then pressed against the rear of the container 26 by way of the framework 6 and moving crosshead 7. At the same time, the holder pistons 12 for moving the container can also be activated to give assistance. By this means, the remains of the billet 25 resting against the die stem 28 are pressed out of the container 26, and enter the bore in the sleeve 46, as shown in FIG. 4*b*. The remains of the billet 25 are then fixed in the sleeve 46 by clamping screws 47, so that on withdrawing the moving crosshead 7 from the sleeve 46, the remains of the billet 25 and any extrusion 48 plus the die 29 are taken with it (see FIG. 4*c*). If an extrusion 48 is present, this can be separated at 49 and 50 and removed. The remains of the billet 25 are removed with the sleeve 46.

FIGS. 5 to 8 show details of the embodiment of FIGS. 3*a* to FIGS. 3*g* to a larger scale.

The profiled stem 41 is removably fixed in the moving crosshead 7 through the stem holder 52 by means of stem foot 51. The front part of the stem 41, which enters the container 26, is reduced to a diameter which is slightly smaller than the bore in the container 26, and is also provided with profile segments 44. The stem 41 and closure disc 32*b* are relieved at their facing ends in such a manner that the profile stem 41 comprises a stem annular groove 53 behind a stem shoulder 54 and the disc 32*b* comprises a disc annular groove 55 behind a disc shoulder 56. The disc 32*b* can be connected to the stem 41 in a positive manner by means of a clamping collar 43 formed of two halves 43*a* and 43*b*, and of which the rear collar shoulder 57 engages in the annular groove 53 of the stem 41 and the front collar shoulder 58 engages in the annular groove 55 of the disc 32*b*, the two halves 43*a* and 43*b* being held together by means of a screw collar ring 42. The lower half 43*a* of the clamping collar 43 forms part of a C-shaped hook 59, which is suspended from a crane by means of a shackle 60. The half 43*b* of the clamping collar 43 is rotatably connected to the half 43*a* or the C-shaped hook 59 by means of a hinge 61. A bolt 63 is inserted into a lug 62 on the C-shaped hook 59, and on which there can slide a bush 64 which by way of the hanger attachment 65 carries the screw collar ring 42 which holds together the halves 43*a* and 43*b* of the clamping collar 43. By sliding the bush 64 on the bolt 63, the screw collar ring 42 can be moved from the position shown in FIG. 5 with the hanger attachment 65, into the position likewise shown in FIG. 5 but without the hanger attachment 65, in which the screw collar ring 42 surrounds the two halves 43*a* and 43*b* of the clamping collar 43. In order to make it possible to mount the clamping collar 43 on the sealing disc 32*b*, the clamp 15 between the holder piston rods 13 which are connected to the container holder 11, and the moving crosshead 7 has to be so closed that on pressing (upsetting and possible boring of the extrusion billet 25), the annular groove 55 and shoulder 56 on the sealing disc 32*b* remain outside the container 26.

Although a special auxiliary die 37 is mounted on the hollow stem 36 in the embodiment of FIGS. 2*a* to 2*e*, in the embodiment of FIGS. 3*a* to 3*g* the profiled stem 41 is either manufactured of, or is clad at its front end with a material such that the use of a special die is not necessary.

It is also possible to dispense with a special closure stem 31, if the hollow stem 36 or profile stem 41 is so sized and constructed as to allow the closure disc 32*a* or 32*b* to be directly supported on it during extrusion.

We claim:

1. In an indirect extrusion press including a press frame formed of a crosshead carrying a main press cylinder and first plunger piston, an opposed die crosshead for supporting an extrusion die having an extrusion die opening, tie members which interconnect said crossheads, a hollow stem mounted on the die crosshead and carrying the extrusion die at its free end, an axially slidable container holder crosshead guided by the press frame, a billet container held by a container holder and having a front open end in the normal extrusion direction and an opposed coaxial rear open end, a movable closure support crosshead associated with and movable by the piston of said main press cylinder, closure means for closing the rear open end of the billet container and carried by the movable closure support crosshead, driving means for effecting relative movement of the closure means and the billet container, and driving means for effecting relative movement of the extrusion die and the billet container, the improvement comprising:

the closure means being removably mounted on the closure support crosshead; and means for reverse extrusion of a billet trapped within the billet container comprising extrusion element means mountable on the closure support crosshead in place of the closure means for insertion into the rear open end of the billet container so that said extrusion element means is biased against the rear end of the billet by the relative movement of the closure support crosshead and the billet container holder crosshead, which extrusion element means has a cross section corresponding to the internal cross section of the billet container rear open end and has at least one extrusion aperture having a cross-sectional area greater than that of the extrusion die opening for reverse extrusion of the trapped billet.

2. An extrusion press as claimed in claim 1 wherein the extrusion element means is in the form of an elongate stem.

3. An extrusion press as claimed in claim 2 wherein the extrusion element means comprises a hollow stem.

4. An extrusion press as claimed in claim 3 wherein the extrusion element means further comprises an extrusion die on said hollow stem.

5. An extrusion press as claimed in claim 2 wherein said closure means comprises a support stem mountable on the closure support crosshead and adapted to support a closure member for closing the rear end of the billet container during forward extrusion, and said support stem and said extrusion element means are interchangeably mountable on the closure support crosshead.

6. An extrusion press as claimed in any of claims 1 or 2 to 4 and 5 wherein:

said movable closure support crosshead is disposed between the cylinder crosshead and die-support crosshead, and said container holder is disposed between the movable crosshead and die-support crosshead and mounted for movement in said press frame in a longitudinal direction.

7. An extrusion press as claimed in claim 5 and further comprising means for fastening said closure member to said support stem in a positive manner so that said closure member can be withdrawn from said container by said support stem.

8. An extrusion press as claimed in claim 5 and further comprising said closure member having a peripheral surface with an annular recess therein, said support stem also having a peripheral surface with an annular recess therein adjacent to the container rear end thereof, and a split clamping collar provided with internal projections for engaging said recesses of the closure member and support stem for fastening the closure member to said support stem in a tension-resisting manner whereby said closure member can be withdrawn from said container.

9. A method of operation of an indirect extrusion press comprising a press frame formed of a crosshead carrying a main press cylinder and first plunger piston, an opposed die crosshead for supporting an extrusion die, tie members which interconnect said crossheads, a hollow stem mounted on the die crosshead and carrying the extrusion die at its free end, an axially slidable container holder crosshead guided by the press frame, a container holder on said container holder crosshead, a billet container held by said container holder and having a front open end in the normal extrusion direction and an opposed coaxial rear open end, a movable closure support crosshead associated with and movable by the piston of said main press cylinder, removable closure means for closing the rear open end of the billet container and carried by the movable closure support crosshead, driving means for effecting relative movement of the closure means and the billet container, and driving means for effecting relative movement of the extrusion die and the billet container;

said method comprising removing from the billet container a metal billet trapped therein in the course of extrusion, the sequential steps of:

providing an extrusion element means mountable on the closure support crosshead for insertion into the rear open end of the billet container against the rear end of the billet which extrusion element means has a cross-section corresponding to the internal cross-section of the billet container rear open end and has at least one extrusion aperture having a cross-sectional area greater than that of the extrusion dis opening for reverse extrusion of the trapped billet.

removing the closure means from the closure support crosshead;

mounting the extrusion element means on the closure support cross head;

inserting into the rear end of the container said extrusion element means having a cross-section providing at least one extrusion aperture;

pressing the extrusion element means against the rear end of the trapped billet, and thereby indirectly reverse extruding through said at least one extrusion aperture a portion of the billet from the rear end of the billet container;

and thereafter expelling the residue of the billet bodily from the container.

10. The method as claimed in claim 9 wherein the billet is extruded from the rear end of the container with a conversion ratio less than that for the extrusion of the billet through the extrusion die.

11. The method as claimed in claim 9 or 10 wherein for expelling the billet residue the billet container is moved over the extrusion die whereby the latter expels the billet residue.

12. The method as claimed in claim 9 or 10 wherein for extrusion of the billet through the extrusion die the billet container, the closure support cross head and the closure means supported thereby are maintained in such relative positions that the closure means projects from the rear end of the container, and wherein in the event the billet is trapped in the container the projecting closure means is removed from the container by relative movement of the container holder and the closure support cross head away from one another.

13. The method as claimed in claim 9 or 10 wherein the indirectly extruded metal emerging from the rear end of the billet container is cut into scrap pieces of handleable size.

14. The method as claimed in claim 9 wherein the reverse indirect extrusion of the billet is continued until it becomes possible to press the remains of the billet out of the container, for which purpose a sleeve having a somewhat greater inner diameter than the bore of the container is inserted at the rear of the container to receive the billet remains.

15. The method as claimed in claim 9 wherein during forward extrusion of the billet the closure means is maintained in a position projecting from the container and wherein prior to removal of a trapped billet from the container the closure means is connected to the closure support cross head and is removed by retraction of the latter.

16. An indirect metal extrusion press comprising apparatus for handling a jammed billet, said press comprising:

(a) a container for billets;

(b) a pressurizing stem positioned to act on one face of a billet in said container;

(c) a die stem containing a die positioned to act on the opposite face of a billet in said container;

(d) first means for forcing said pressurizing stem and said die stem towards each other, thereby normally forcing said die stem into said container and forcing the billet out through said die; and (e) an ejecting stem which is selectively substituted for said pressurizing stem, said ejecting stem having a plurality of longitudinal grooves in the surface of said ejecting stem, which grooves extend in the direction of motion of said ejecting stem, the cross-sectional area of said plurality of longitudinal grooves being greater than the cross-sectional area of the opening in said die, whereby, when a billet becomes jammed in said container, said ejecting stem is substituted for said pressurizing stem and the billet is forced out through said plurality of longitudinal grooves.

17. An extrusion press as claimed in claim 16 wherein said ejecting stem comprises a piercing stem provided with externally open profile segments extending along at least part of the length thereof.

18. A method for removing a jammed billet from a container in an indirect metal extrusion press having the container, a pressurizing stem which acts on one face of the billet, and a die stem containing a die which acts on the opposite face of the billet, in which a billet is normally extruded from the container through the die by forcing the die stem and the pressurizing stem towards one another, thereby forcing the die stem into the container and forcing the billet out through the die, said method comprising the steps of:

providing a removable pressurizing stem;

providing a removable reverse extruding ejecting stem having an axial opening in the face thereof which is adjacent the billet when in use, which axial opening has a greater cross-sectional area than the opening in the die;

removing the pressurizing stem and replacing it with the ejecting stem; and forcing the die stem and the ejecting stem towards one another, thereby forcing the ejecting stem into the container and forcing the billet out through the axial opening in the ejecting stem.

19. A method for removing a jammed billet from a container in an indirect metal extrusion press comprising the container, a pressurizing stem which acts on one face of the billet, and a die stem containing a die having an opening which acts on the opposite face of the billet, in which a billet is normally extruded from the container through the die opening by forcing the die stem and the pressurizing stem towards one another, thereby forcing the die stem in the container and forcing the billet out through the die, said method comprising the steps of:

providing in place of the pressurizing stem an ejecting stem having a plurality of longitudinal grooves in the surface thereof which extend in the direction of motion of the ejecting stem and have a greater cross-sectional area than the opening in the die; and forcing the die stem and the ejecting stem towards one another, thereby forcing the ejecting stem into the container and forcing the billet out through the grooves in the ejecting stem.

20. An indirect metal extrusion press having apparatus for handling a jammed billet comprising:

a container for billets;

a pressurizing stem removably positioned to act on one face of a billet in said container;

a die stem containing a die having an opening positioned to act on the opposite face of a billet in said container;

means for forcing said pressurizing stem and said die stem towards each other and to normally force said die stem into said container thereby forcing the billet out through said die;

a removable ejecting stem for replacing said pressurizing stem when said pressurizing stem is removed;

an annular auxiliary die;

means to selectively position said annular auxiliary die between said billet and ejecting stem when said ejecting stem has replaced said pressurizing stem;

an axial opening formed in said auxiliary die which has a greater cross-sectional area than the opening in the die; and an axial opening in said ejecting stem having a cross-sectional area greater than the opening in the die and communicating with said axial opening in said auxiliary die;

so that, when a billet becomes jammed in said container, said pressurizing stem is removed and replaced by said ejecting stem and said auxiliary die is in position with the axial opening thereof communicating with the axial opening in said ejecting stem, and said ejecting stem and die stem are forced towards each other, the billet is forced out through said axial opening in said auxiliary die.

* * * * *